United States Patent [19]

Curry

[11] Patent Number: 4,457,380

[45] Date of Patent: Jul. 3, 1984

[54] BLADES FOR EARTH MOVING MACHINES

[76] Inventor: John N. Curry, 148A Northern Rd., Heidelberg West, Victoria 3081, Australia

[21] Appl. No.: 270,090

[22] Filed: Jun. 3, 1981

[51] Int. Cl.[3] ..... E02F 9/28

[52] U.S. Cl. ..... 172/701.3; 172/753; 37/141 R

[58] Field of Search ..... 172/753, 701.1, 701.2, 172/701.3, 734, 736, 737, 744, 702, 703, 704, 719; 37/141 R, 142 R, 142 A, 141 T

[56] References Cited

U.S. PATENT DOCUMENTS

| | | | |
|---|---|---|---|
| 989,729 | 4/1911 | Swindle | 172/753 X |
| 1,944,307 | 1/1934 | Spoon | 172/701.1 |
| 2,584,868 | 2/1952 | Guess | 37/141 R |
| 2,708,865 | 5/1955 | Frevik | 172/753 |
| 2,778,129 | 1/1957 | Fryer | 37/141 R |
| 3,864,853 | 2/1975 | Klett | 172/753 |
| 4,108,250 | 8/1978 | Merkel | 172/719 |

*Primary Examiner*—Richard J. Johnson
*Attorney, Agent, or Firm*—Griffin, Branigan & Butler

[57] ABSTRACT

A pair of cutting edge members are adapted to be fastened to a blade-like support member of an earth moving machine. The pair includes a female cutting edge member (A) and a male cutting edge member (B), each member having ground-engaging edges at opposite ends thereof. The female cutting edge member (A) has, in at least one of its opposite side edges (17, 18), female interlocking means (19) for engagement by complementary means (23) on the male cutting edge member (B). The female and male interlocking means (A, B) are so arranged that one cutting edge member may be adjusted linearly in position on the support member of the earth moving machine relative to the adjacent cutting edge member. Moreover, a cutting edge member can be reversed in position end-for-end and interlocked again with an adjacent cutting edge member.

10 Claims, 7 Drawing Figures

FIG.1
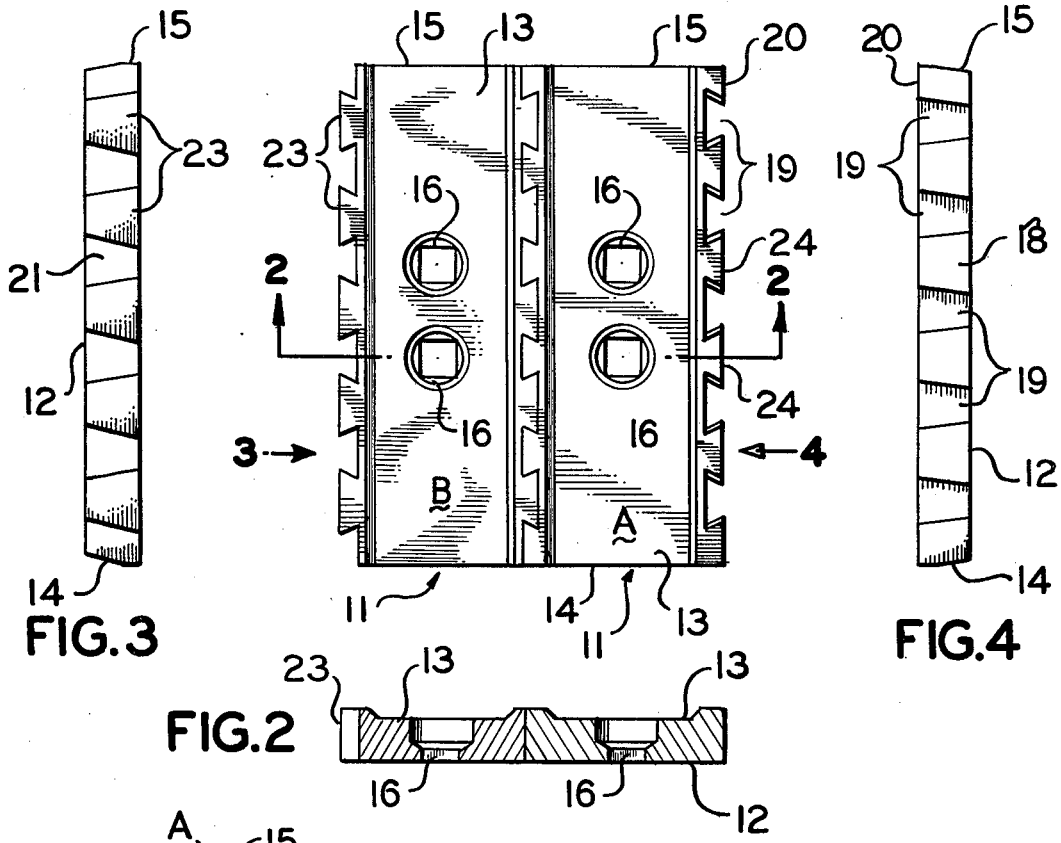
FIG.3 FIG.2 FIG.4
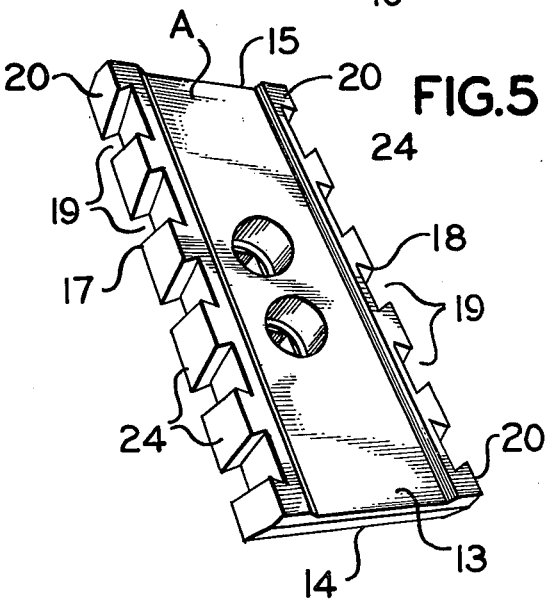
FIG.5
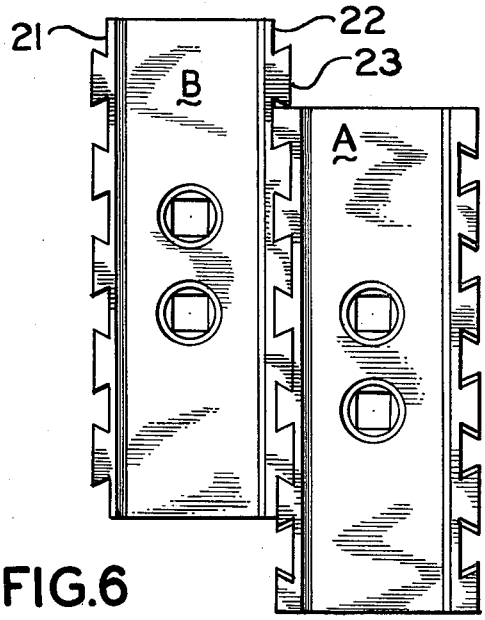
FIG.6
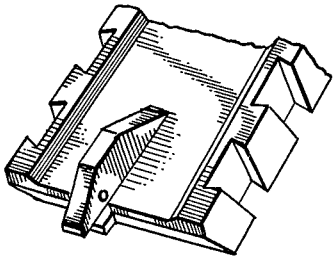
FIG.7

BLADES FOR EARTH MOVING MACHINES

BACKGROUND OF THE INVENTION

1. Field of the Invention

This invention relates to improvements in blades for earth moving machines such as scrapers, graders, bulldozers and so on (hereinafter referred to as "scrapers") and it refers particularly to the cutting edges—the operative cutting edge portions of the blades.

2. Description of the Prior Art

The ground-engaging tools of bulldozers, scrapers, graders and other earth moving machines are made in a wide variety of types, according to the purposes for which the tools are to be used. In general, there are replaceable edge members capable of being bolted in position on a support assembly, such as a scraper blade, and those edge members may be made to suit a level cut arrangement (with the front edges of the several members all in line), in a drop centre or stinger arrangement (when the middle part projects forwardly of the two side parts), with integral forwardly-projecting teeth, with replaceable forwardly projecting teeth, substantially planar in shape to suit scrapers, curved to suit graders, with front and rear edges so that they may be reversed, and so on. The edge members for a machine may be made in one piece to extend the full width of the tools to which they are to be attached or they may be made in shorter sections so that three, four or more members are bolted in position on a support member to make up the full width of the earth-engaging tool.

OBJECTS OF THE INVENTION

This invention is applicable to all such edge members but for simplicity of description they will be referred to as cutting edges or edge members for scraper blades without limiting the invention to the blades of such machines.

This invention has been devised particularly with the object of providing a construction of cutting edge for a scraper blade such that the range of use of the cutting edge will be greatly increased. Another object is to provide cutting edges so constructed that they may be reversed in position, interchanged, and/or used in the straight or level-cut operational position or in the so-called "drop" or "stinger" position, as required. A further object is to provide cutting edges which will be easy to replace and/or adjust in position.

Yet another object is to provide a cutting edge of such construction that a broken or worn part of the cutting edge may be replaced without the necessity of replacing the whole cutting edge.

BRIEF SUMMARY OF THE INVENTION

The invention devised with these and other objects in view provides cutting edge members for scraper blades having means for interlocking with adjacent cutting edges whereby each cutting edge, when securely mounted in position on a scraper blade, will be engaged with the adjacent cutting edge or edges, the cutting edge members being adjustable and reversible in position one relative to the other.

It is preferred that the means for interlocking be dovetailed parts, preferably tapered, on the opposite side edges of the cutting edge members so arranged that when two such cutting edge members are mounted on a scraper blade in side-by-side relationship the dovetailed parts on one side of one such cutting edge member will interengage with those on the adjacent side of the next cutting edge member. It is also preferred that each of the cutting edge members be provided with two fastening holes by which it may be fastened to the scraper blade, and that the dovetailed parts have the same linear spacing as said holes so that if a cutting edge member is moved, relative to an adjacent cutting edge member, the dovetailed parts will still interengage so as to lock together the two said cutting edge members.

Preferably, the dovetailed parts on one cutting edge member are tapered downwardly and inwardly, so that they are wider at the top than at the bottom, thus providing a male cutting edge member, and the dovetailed parts of the next adjacent cutting edge members are tapered in the opposite direction, so that they are wider at the bottom than at the top, the recesses between said dovetail parts being the same shape as the dovetail parts of the first-mentioned cutting edge member, the second said cutting edge member being the female member. Thus, the cutting edge members will be adapted to interlock in the longitudinal direction and transverse directions, and in the vertical direction as well—considering the cutting edge members as being horizontal.

Thus, there will be two different cutting edge members, one having the dovetailed members tapered in one direction and the other having the dovetailed members tapered in the opposite direction.

In order to provide for a reversal of each cutting edge member so that, when one end is worn, it may be turned end-for-end and an unworn edge put into operational position, each end is shaped to provide a desired "edge" and the dovetailed parts of the two different cutting edge members will be arranged so that they will interengage even when one of them is reversed in position relative to the other without any change in related position of the fastening holes.

Also, the spacing of the dovetailed parts in relation to the spacing of the fastening holes is such that one cutting edge member may be moved longitudinally relative to the adjacent members into a drop centre or stinger position, and be bolted in that position.

In order that the invention may be readily understood and conveniently put into practical form we shall now describe with reference to the accompanying illustrative drawings one exemplary construction of cutting edges for earth moving machines, and a modification thereof.

BRIEF DESCRIPTION OF THE DRAWINGS

FIG. 1 is a plan view of a pair of male and female members in interengaged relationship;

FIG. 2 shows a transverse cross-section on the line and in the direction of the arrows 2—2 of FIG. 1;

FIG. 3 and FIG. 4 are side elevations of the male and female members, respectively, in the directions of the arrows 3 and 4 adjacent FIG. 1;

FIG. 5 is a perspective view of the female member;

FIG. 6 shows a plan view of the male and female members in adjusted relative positions; and FIG. 7 is a perspective view of a modified construction.

DETAILED DESCRIPTION OF THE DRAWINGS

According to this invention the cutting edge of a scraper (or other earth moving machine as defined above) is made up of a number of female members A and male members B which are arranged in side-by-side interengaging relationship. In these drawings only one of each member is illustrated but it will be appreciated that there are provided as many as may be required to extend the full width of the scraper blade.

Each of the members A and B has a body portion 11 with a flat underside 12, a dished upper side 13, front and rear ends 14 and 15 respectively, and opposite side walls made for interlocking engagement with the side walls of adjacent members. In each body portion 11 are two longitudinally spaced fastening holes 16 made to receive the fastening bolts by which the cutting edge members are fastened to the scraper blade. The effective width of each of the cutting edge members is such that when they are fastened together the fastening holes 16 will be spaced laterally a distance to suit the spacing of the fastening holes in the scraper blade.

The two side walls 17, 18 of each female member A are provided with a series of dovetail recesses 19 which are wider at the top than at the bottom, with end pieces 20 at the opposite ends, and the side walls 21, 20 of each male member B have a series of male dovetail parts 23 of a shape, size and longitudinal spacing corresponding to the dimensions of the dovetail recesses 19 so as to be capable of being interfitted therewith.

The spacing of the dovetail recesses 19 is the same on the two sides of each female member A and, similarly, the spacing of the male dovetail parts 23 is the same on each side of each male member B. The dovetail recesses 19 and lands 24 between them are so arranged that on each side of each female member a land 24 is in transverse alignment with a fastening hole 16, the pitch of the dovetail recesses 19 and of the dovetail parts 23 being the same as the longitudinal spacing of the fastening holes 16.

It is clear that with that arrangement and spacing of the dovetail recesses 19 and dovetail parts 23, when a number of male and female members are connected together in interlocking arrangement to a male member B may be removed from the scraper blade to which it is fastened, reversed end-for-end, and re-engaged with the adjacent female member or members. If it is desired to reverse a female member A in position it is of course necessary to unbolt the adjacent male member or members B, reverse the female member A and then fasten the male member or members back in position.

Further, if it is desired to set a number of the cutting edge members in the drop position those members may be moved longitudinally forwards in relation to the remaining members, in the manner as illustrated in FIG. 6, by the amount of one pitch of the dovetail parts 23 and then re-bolted in position.

It is believed that when a number of cutting edge members made according to the invention are correctly bolted to a scraper blade and the scraper is being so operated that the cutting edges dig into the ground the pressure on the several edge members is in an anti-clockwise direction and the individual edge members will lock with the adjacent members on the taper of the interengaging dovetail parts; similarly, when the machine is operated to move forwardly the pressure on the edge members is in the opposite direction, and the individual edge members will again lock with adjacent members on the taper of the interengaging dovetail parts.

Reference is now made to FIG. 7 which illustrates a modification wherein the end of the cutting edge member has a nose 26 adapted to receive and hold a tooth, as for elevating scrapers.

It is to be understood that the invention is not limited to the particular interlocking edge means described and illustrated—the female dovetail recesses 19 and male dovetail members 23. Thus, it may be found convenient to provide longitudinally arranged dovetail recesses in the opposite sides of female member A and complementary, longitudinally arranged dovetail members on the opposite sides of the male member B. Alternatively, instead of dovetail interengaging parts the male and female members may be provided with tongue-and-groove interfitting parts to permit replacement of individual parts of the scraper cutting edge and/or end-for-end reversal of such individual parts.

The cutting edge members according to this invention may be made of shell moulding operations of a suitable alloy steel. Merely by way of example, the steel may have the following analysis:

| | |
|---|---|
| Carbon | 0.28% |
| Silicon | 0.60% |
| Manganese | 0.87% |
| Sulphur | 0.014% maximum |
| Phosphorus | 0.018% maximum |
| Chromium | 1.87% |
| Nickel | 0.07% |
| Molybdenum | 0.61% |
| the remainder being iron. | |

However, other alloys known in the art may be found to be more suitable.

As the cutting edge members are made relatively narrow in the transverse direction each cutting edge member will be substantially lighter than cutting edges as hitherto provided and one man will be able to handle them with ease, so that one operator may replace or change the position of a cutting edge member, or a number of cutting edge members, on his own.

It will be understood that the cutting edge members as herein described may be made as toothed cutting edge members—each said cutting edge member having one or more teeth at one or both ends—or they may be made to support replaceable teeth in known manner.

It is to be appreciated that other modifications in details of design, construction and/or arrangement may be made and that the invention is not limited to the particular construction of cutting edges described above in detail. All such modifications are to be deemed to be included in the ambit of the invention as defined by the appended claims.

What is claimed is:

1. A pair of cutting edge members adapted to be fastened to a blade-like support member of an earth moving machine, said pair comprising a female cutting edge member and a male cutting edge member, each having ground-engaging edges at its opposite ends, the female cutting edge member having in at least one of its opposite side edges female interlocking means for engagement by complementary means on the male cutting edge member and the male cutting edge member having on at least one of its opposite side edges male interlocking means for interlocking engagement with said female interlocking means of the female cutting edge member, the said female and male interlocking means being so arranged that one cutting edge member may be adjusted linearly in position on the support member of the earth moving machine relative to the adjacent at least one cutting edge member and may also be reversed in position end-for-end and interlocked again with that adjacent cutting edge member so as to be adapted to be fastened again to said support member of said earth moving machine.

2. A cutting edge member as claimed in claim 1 wherein the interlocking means are dovetail parts on the opposite sides of the cutting edge member, said dovetail parts being engageable in interlocking manner with complementary dovetail parts of adjacent cutting edge members.

3. A cutting edge member as claimed in claim 2 wherein the dovetail parts extend in a direction normal to the plane of the edge member and are of the same shape and are longitudinally spaced equally on both sides of the cutting edge member.

4. A pair of cutting edge members are claimed in claim 2 wherein the dovetail parts of each member are tapered, the dovetail parts of one member being wider at the top than at the bottom and the dovetail parts of the other member being wider at the bottom than at the top such that the dovetail recesses of the latter member are the same size and shape as and adapted to receive the dovetail parts of the first member.

5. A cutting edge member as claimed in claim 1 or claim 2 wherein the dovetail parts extend longitudinally along the opposite sides of the cutting edge member.

6. A cutting edge member as claimed in claim 1 wherein the interlocking means are tongue-and-groove means on the opposite sides of the cutting edge member.

7. A cutting edge member as claimed in claim 1 wherein the body part has two fastening holes for the reception of bolts for fastening the edge member to the scraper blade.

8. A cutting edge member as claimed in claim 7 wherein the interlocking means are dovetail parts on the opposite sides of the cutting edge member, said dovetail parts being engageable in interlocking manner with complementary dovetail parts of adjacent cutting edge members and the longitudinal spacing of the fastening holes is the same as the longitudinal spacing of the dovetail parts.

9. A pair of cutting edge members adapted to be fastened to a blade-like support member of an earth moving machine, said pair including a female cutting edge member and a male cutting edge member, each having ground-engaging edges at its opposite ends, the female cutting edge member having along its opposing side edges female interlocking means, complementary male interlocking means along opposing side edges of the male cutting edge member, the said female and male interlocking means being so arranged that each of the cutting edge members may be adjusted linearly in position on the support member of the earth moving machine relative to the other cutting edge member and may also be reversed in position end-for-end and interlocked again with that other cutting edge member so as to be adapted to be fastened again to said support member of said earth moving machine.

10. Cutting edge members in combination with a blade-like support member of a scraper element, said combination comprising:

a blade-like support member to which said cutting edge members are selectively fastened;

at least one male cutting edge member having ground-engaging edges at opposite ends thereof and male interlocking means provided along opposing side edges thereof;

at least one female cutting edge member adapted to interlock with an adjacent male cutting edge member, said female cutting member also having ground-engaging edges at opposite ends thereof and further having female interlocking means provided along opposing side edges thereof adapted to interlock with said male interlocking means provided on said adjacent male cutting member;

means for fastening said male cutting edge member and said female cutting edge member to said support member, said male and female cutting edge members being in direct interlocking contact with one another when fastened to said support member, the said female and male interlocking means being so arranged that one cutting edge member may be adjusted linearly in position on the blade of the scraper element relative to the other cutting edge member and may also be reversed in position end-for-end and interlocked again with that other cutting edge member so as to be adapted to be fastened again to said blade of said scraper element.

* * * * *